US010590720B2

(12) United States Patent
Manum et al.

(10) Patent No.: US 10,590,720 B2
(45) Date of Patent: Mar. 17, 2020

(54) SYSTEM AND METHOD FOR OBTAINING AN EFFECTIVE BULK MODULUS OF A MANAGED PRESSURE DRILLING SYSTEM

(71) Applicant: STATOIL PETROLEUM AS, Stavanger (NO)

(72) Inventors: Henrik Manum, Trondheim (NO); Åsmund Hjulstad, Bru (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 15/757,549

(22) PCT Filed: Sep. 2, 2016

(86) PCT No.: PCT/NO2016/050182
§ 371 (c)(1),
(2) Date: Mar. 5, 2018

(87) PCT Pub. No.: WO2017/039459
PCT Pub. Date: Mar. 9, 2017

(65) Prior Publication Data

US 2018/0245412 A1 Aug. 30, 2018

(30) Foreign Application Priority Data

Sep. 4, 2015 (GB) ..... 1515700.1

(51) Int. Cl.
*E21B 21/08* (2006.01)
*E21B 47/00* (2012.01)
*E21B 47/14* (2006.01)

(52) U.S. Cl.
CPC ..... *E21B 21/08* (2013.01); *E21B 47/00* (2013.01); *E21B 47/14* (2013.01)

(58) Field of Classification Search
CPC ..... E21B 47/00; E21B 47/14; E21B 21/08
See application file for complete search history.

(56) References Cited

U.S. PATENT DOCUMENTS

| | | | |
|---|---|---|---|
| 5,475,650 | A | 12/1995 | Sinha et al. |
| 2002/0101373 | A1 | 8/2002 | Arndt et al. |
| 2006/0175090 | A1 | 8/2006 | Reitsma et al. |

(Continued)

FOREIGN PATENT DOCUMENTS

| | | |
|---|---|---|
| EP | 0 466 229 | 1/1992 |
| GB | 2473672 | 3/2011 |

(Continued)

OTHER PUBLICATIONS

International Search Report and Written Opinion of the International Searching Authority dated Nov. 25, 2015 in International (PCT) Application No. PCT/N02016/050182.

(Continued)

*Primary Examiner* — Kristyn A Hall
(74) *Attorney, Agent, or Firm* — Wenderoth, Lind & Ponack, L.L.P.

(57) ABSTRACT

A method of obtaining an effective bulk modulus of a managed pressure drilling system is disclosed. The method includes generating a pressure wave in the managed pressure drilling system; measuring a time interval for the pressure wave to travel over a distance in the managed pressure drilling system; and calculating the effective bulk modulus of the managed pressure drilling system using the time interval and the distance.

21 Claims, 1 Drawing Sheet

(56) References Cited

U.S. PATENT DOCUMENTS

| | | | |
|---|---|---|---|
| 2009/0282907 | A1 | 11/2009 | Zazovsky et al. |
| 2012/0170406 | A1 | 7/2012 | DiFoggio et al. |

FOREIGN PATENT DOCUMENTS

| | | |
|---|---|---|
| WO | 2008/118986 | 10/2008 |
| WO | 2011/036144 | 3/2011 |
| WO | 2013/154537 | 10/2013 |
| WO | 2016/014791 | 1/2016 |
| WO | 2016-120473 | 8/2016 |

OTHER PUBLICATIONS

Search Report dated Oct. 19, 2015 in corresponding GB Application No. 1515700.1.

Kaasa et at., "Simplified Hydraulics Model Used for Intelligent Estimation of Downhole Pressure for a Managed-Pressure-Drilling Control System", SPE Drilling & Completion, vol. 27, No. 1, Mar. 2012, pp. 127-138.

Aarsnes et al., "Limits of Controller Performance in the Heave Disturbance Attenuation Problem", European Control Conference (ECC), pp. 1071-1076, (Jul. 17, 2013) XP032526841.

Piccolo et al., "Verification of Pore and Fracture Pressure Margins during Managed Pressure Drilling", SPE/IADC Managed Pressure Drilling and Underbalanced Operations Conference and Exhibition, Apr. 2014, SPE/IADC SPE-168958-MS.

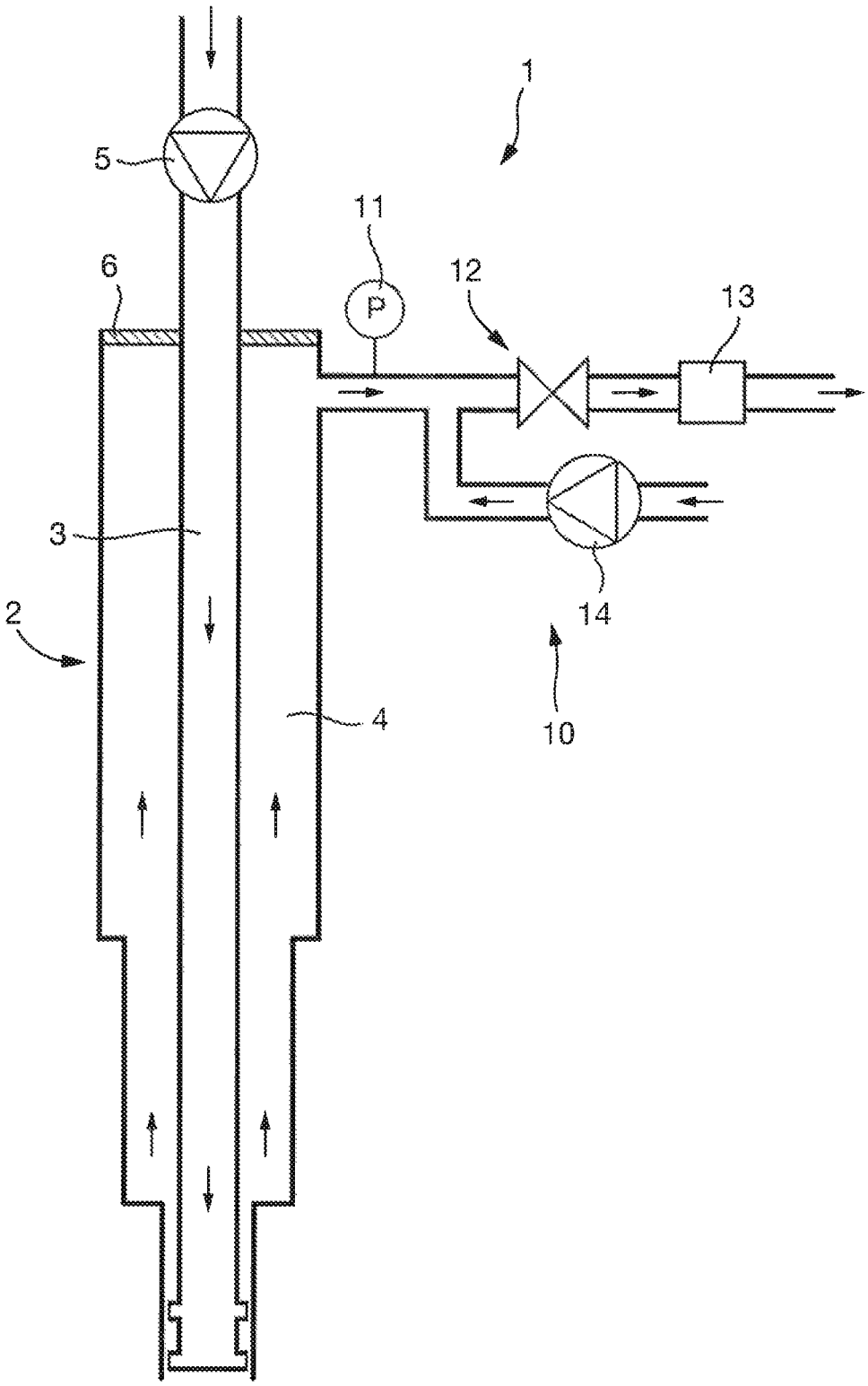
1
5
11
P
12
13
6
3
2
14
10
4

SYSTEM AND METHOD FOR OBTAINING AN EFFECTIVE BULK MODULUS OF A MANAGED PRESSURE DRILLING SYSTEM

BACKGROUND OF THE INVENTION

1. Field of the Invention

The present invention relates to a method of obtaining an effective bulk modulus of a managed pressure drilling system, and to a managed pressure drilling system.

2. Description of Related Art

In managed pressure drilling systems, the bulk modulus is used as a parameter to tune the control of the system. It is therefore desirable to accurately determine the bulk modulus to improve the effectiveness of managed pressure drilling control algorithms.

An existing method of calculating the bulk modulus of a material is provided in US 2009/0282907. In this method, the velocity of pressure waves in a mudcake is found, and this velocity is used to calculate the bulk modulus of the material of the mudcake. The bulk modulus of the material of the mudcake is used to calculate the integrity of the mudcake.

SUMMARY OF THE INVENTION

The present invention provides a method of obtaining an effective bulk modulus of a managed pressure drilling system, the method comprising: generating a pressure wave in the system; measuring the time interval for the pressure wave to travel over a distance in the system; and calculating the effective bulk modulus of the system using the time interval and the length.

This invention allows the effective bulk modulus of the system to be calculated whilst the system is online. This may be achieved since all the steps can be performed when the system is online. This not only reduces the down time of the system, but can also provide more accurate and up-to-date values for the effective bulk modulus of the system. Having an accurate and up-to-date effective bulk modulus of the system is beneficial for instance for tuning the system.

Further, the present invention calculates the effective bulk modulus, i.e. the bulk modulus of the system as a whole (e.g. the drilling mud, the system's casing, the open borehole, the drill string, entrained gas within the system, the riser etc.), and not just of the material being pumped through the managed pressure drilling system.

For use in tuning, it is the bulk modulus of the entire system, i.e. the effective bulk modulus, which is most useful. Using pressure waves to calculate the bulk modulus of the system when it is online is advantageous since using the pressure waves necessarily/automatically calculates the effective bulk modulus characteristic of the entire system, because the propagation of the pressure wave is dependent on the effective bulk modulus.

In the present disclosure, the "effective bulk modulus" can be thought of as a parameter that describes the response of the managed pressure drilling system as a whole when a pressure wave passes through the system or through the wellbore (e.g. the whole of the system or the wellbore), e.g. at least through the drilling fluid (or mud or fluid or material) and the casing/components of the managed pressure drilling system contacting the drilling fluid (or mud or fluid or material). It is a global parameter describing the effect of all the components/fluid through which the measured pressure wave passes, and which affect the measured wave.

Any component of the system that is in sufficient communication with the drilling fluid such that the component would affect the measured pressure wave is of interest when tuning.

A bulk modulus of a material may be thought of as a material's resistance to compression. This is not what is meant by the "effective bulk modulus of the system". The bulk modulus of a material can be calculated by measuring the response of a material when a pressure wave passes through it.

It is the bulk modulus of the material, rather than the effective bulk modulus, that is found in US 2009/0282907. The bulk modulus of the material of the mudcake only is found in US 2009/0282907 in order to calculate the mudcake integrity. It is not used in tuning the system.

The effective bulk modulus of the system should be thought of as a parameter that is found by measuring the response of the system as a whole when a pressure wave passes through it. Thus, it is found in the same, or a similar, way as a material's bulk modulus may be found. However, unlike a material bulk modulus, it is not rigorous or correct to think of the effective bulk modulus of the system as a whole as "the system's resistance to compression". Rather, it merely helps describe the response of the system as a whole to the pressure wave. The term "bulk modulus" is used to describe the system's response merely because it has the same units as a material bulk modulus, and can be found in a similar way.

Thus, looked at another way, it should be understood that the effective bulk modulus of the system is not a material bulk modulus value. A material bulk modulus defines the characteristics (e.g. speed) of a pressure wave propagating through a material. The effective bulk modulus of a system describes the characteristics of a pressure wave propagating through the system as a whole.

Thus, the effective bulk modulus of the system includes effects on the wave propagation from the drilling fluid (in the wellbore annulus at least) and any components contacting the fluid which affect the propagation of the pressure wave (such as wellbore casing, the drilling string casing, the open borehole, the drill string, entrained gas within the system and/or the riser). What the inventors have found is that during tuning it is useful to know what the response of the system is to a propagating pressure wave. This response is of course only affected by the components of the system that affect the propagation of a pressure wave. This response has been termed "the effective bulk modulus of the system". Therefore, the effective bulk modulus of the system takes into consideration the effect of all of the components that affect the propagation of the pressure wave (and no other components).

In particular, the drilling fluid (e.g. the mud) and the wellbore casing (and possibly other components in the well) surrounding the fluid may contribute to the effective bulk modulus of the system, when a pressure wave is produced in the system/fluid and measured in the system/fluid. The fluid may contribute due to its material bulk modulus. The casing may contribute as it is contact with the fluid, so the pressure wave may pass from the fluid to the casing, and vice versa. The flexibility of the casing may affect the wave propagation, and hence the effective bulk modulus of the system. The material bulk modulus of the material of the casing may affect the wave propagation, and hence the effective bulk modulus of the system.

Thus, the method may include calculating the effective bulk modulus of the whole system. Here the whole system is intended to mean any part of the system (e.g. the drilling mud/fluid, the system's casing, the open borehole, the drill string, entrained gas within the system, the riser etc.) that may affect, and may be affected by, a propagating pressure wave in the drilling fluid.

It should be understood that by "calculating an effective bulk modulus" it is intend to cover any equivalent calculation, such as calculating an effective compressibility, the compressibility merely being the reciprocal of the bulk modulus.

Prior art systems determine material bulk modulus, and hence do not provide the same advantages. For example, one prior art method of determining the material bulk modulus is simply to measure the bulk modulus of a sample of the material in the system. This is typically done outside of the managed pressure drilling system, e.g. in a laboratory environment. Since only a sample is used, and since the bulk modulus is calculated outside of the managed pressure drilling system, the material bulk modulus calculated in this manner is less useful than the effective bulk modulus calculated by the present method.

The generated pressure wave may be such that the pressure wave propagates through drilling fluid in a well bore of the system and components of the managed pressure drilling system contacted by the drilling fluid, such as the annulus casing. The pressure wave may propagate through drilling fluid in a wellbore annulus of the system, and preferably the components in contact with the drilling fluid in the wellbore annulus The pressure wave may travel through at least 10%, 20%, 25%, 30%, 40%, 50%, 60%, 70%, 75%, 80% or 90% of the length of the wellbore. Indeed, when the pressure wave is reflected (see below), the pressure wave, whilst travelling through at least 10%, 20%, 25%, 30%, 40%, 50%, 60%, 70%, 75%, 80% or 90%, may travel over a distance (e.g. from source to sensor) of at least 20%, 40%, 50%, 60%, 80%, 100%, 120%, 140%, 150%, 160% or 180% (respectively) of the length of the wellbore.

The pressure wave may be generated at a source.

The source of the pressure wave may be external to the managed pressure drilling system. Preferably, however, the source of the pressure wave may be an existing component of the system. Thus, no additional hardware may be needed. The existing component may be a back pressure pump. The existing component may be a choke valve. It is known in certain prior art managed pressure drilling systems to generate back pressure pulses in a managed pressure drilling system using a choke valve, for example in the paper Verification of Pore and Fracture Pressure Margins during Managed Pressure Drilling by B. Piccolo, P. Savage, H. Pinkstone, C. Leuchtenberg, SPE/IADC, 2014. However, in the prior art back pressure pulses are used only to calculate a wellbore storage factor using a first order model, and not to calculate the effective bulk modulus of the system.

Using an existing component of the system is particularly advantageous for the present invention, especially if that existing component of the system is a component that can be used to tune the managed pressure drilling system (such as a back pressure pump and/or a choke valve). The inventors have discovered that a useful parameter of the system to know during tuning is the effective bulk modulus of the system as a whole. As discussed above, the effective bulk modulus of the system as a whole is defined as the response of the system as a whole to a pressure wave produced within the system. For use when tuning, it is particularly desirable to know the response of the system as a whole to a pressure wave produced by the existing component used during tuning (such as the back pressure pump and/or the choke valve).

The source may preferably be able to vary the pressure in the system quickly enough to generate a pressure wave travelling upstream. For instance, the pressure variation may need to occur on a scale of less than 1 s to produce an adequate pressure wave.

The choke valve is a favored component for use as the source of the pressure wave. It will generally be the case that no modification to the physical parts of the system is required to use a choke valve in this way; instead, there may be only modifications to the control of the system. Advantageously, the position of the choke valve can be changed very quickly, such as at time scales of shorter than 1 s.

In normal use, the choke is used to control the pressure in the system to be within a desired range. Using the choke to sharply increase or decrease the pressure in the system to generate a pressure wave would therefore usually be discouraged for safety reasons. However, if this is done for a short enough time, there is no negative or dangerous effect on the system. Rather, the outcome is that a pressure wave travels upstream. The inventors have found that using the choke valve in this manner can be used to calculate the effective bulk modulus of the entire system when the system is running/online. To generate the wave, the position of the choke may be changed in a pre-defined manner whilst the rig pump and/or back pressure pump of the system is/are running. The choke valve may be opened and/or closed. The change in position of the choke valve may be a change in the extent of which the choke valve is open. The choke valve position may be changed to an extent such that it causes a significant pressure change in the system. A significant pressure change is a pressure change that will cause a recordable propagating wave, for example a 1-5 bar pressure change.

The source of the pressure wave may be at a topside location of the system. In a managed pressure drilling system, there is a topside where components that are used to manage the pressure of the system (such as choke(s), flow meter(s) and pressure sensor(s)) are located. The topside is typically located at an upper part of the wellbore, preferably the substantially uppermost part of the wellbore, or at an upper part of the riser, preferably the substantially uppermost part of the riser. The topside may be connected to the riser or the wellbore, preferably the wellbore annulus, such that the pressure in the riser and/or wellbore can be controlled.

The managed pressure drilling system may comprise a wellbore. The system may comprise a riser. The riser may be connected to the wellbore such that the material may pass through the riser and the wellbore and pass between the riser and the wellbore, preferably the wellbore annulus.

Having the source in the topside location of the system is advantageous since it may increase the distance over which the pressure wave may travel, which in turn may improve the accuracy of the time interval measurement. Further, since the topside is fluidly connected to the riser or wellbore, having the source in the topside ensures propagation of the pressure wave through the riser and/or wellbore. Further, since there are already numerous components present in the topside, access to the topside is relatively straightforward for installing the source. Further, one of the components already present in the topside may be used as the source. Further, since there is typically already a pressure sensor present in the topside, this pressure sensor may be used to measure the time interval. Alternatively, the already-present flow meter may be used to measure the time interval.

The distance in the system travelled by the pressure wave may be approximately double the length of the wellbore, or double the total length of the riser and the wellbore. This distance may be achieved by placing the source proximate the top of the wellbore or the riser respectively. The pressure wave may travel down the length of (the riser and) the wellbore to the bottom of the wellbore, preferably through the wellbore annulus.

The pressure wave may be reflected. The reflection may occur at a reflection location. The reflection may occur at a time during the time interval. The reflection may therefore occur at a time between the start and the end of the time interval. The reflection may occur at any location in the system where impedance changes. The reflection may occur at the bottom of the wellbore. The reflection may occur where the geometry of the system changes, e.g. when transitioning between the riser and the wellbore, or at the location where the diameter of the riser or wellbore changes (which may be where different diameter casings meet), or where the cross section of the system changes (such as the cross section of the riser or wellbore). The bottom of the wellbore may be the preferred reflection location since this gives the longest distance and time interval. However, other reflections may be preferred as there will be less attenuation of the pressure wave over shorter distances.

Reflections may also occur where fluid in the system changes, e.g. density changes.

More than one reflection can be used. This can help provide a more accurate estimate of the bulk modulus.

A reflection location is the location in the system at which the pressure wave is reflected.

The reflection location of the measured reflected pressure wave would need to be known, so that the total distance travelled by the pressure wave in the time interval is known. The depth of the reflection can be found because the locations of geometry changes, fluid changes and/or the bottom of the wellbore are typically known. In the case where there are multiple reflections, or multiple possible locations from which the reflected pressure wave could have reflected, it may be necessary to determine the reflection location of the/each reflected pressure wave. This can be achieved by having knowledge of possible reflection depths, and having knowledge of approximate anticipated bulk modulus values. The reflection depth (and hence the distance over which the pressure wave travels) and the corresponding bulk modulus can be calculated using said knowledge of possible reflection depths and anticipated bulk modulus values. This calculation may be iterative.

Additionally or alternatively, the depth of the reflection location of the first and/or last measured reflected pressure wave arrival can be correlated to the nearest and/or furthest possible reflection location respectively. The remaining reflections can then be correlated to the remaining reflection locations by correlating the next and/or previous reflected pressure wave to the respective next and/or previous possible reflection location.

The pressure wave may travel through the material in the system in an upstream direction. When the pressure wave reaches a reflection location, e.g. the bottom of the well bore, it may be reflected. The reflected pressure wave may then travel up the length of the wellbore, preferably through the wellbore annulus, and/or may travel up through the riser. The reflected pressure wave, and possibly the generated pressure wave, may be measured proximate the top of the wellbore or riser, e.g. in the topside.

Thus, the pressure wave may travel from the source, down the riser and/or wellbore to a reflection location where it is reflected back up the wellbore and/or the riser. Having the pressure wave travel in this way provides a longer time interval, which can improve the accuracy of the measurement. Further, it effectively allows the pressure wave to travel through the system twice, once upstream and once downstream. This can improve the accuracy of the effective bulk modulus found using this method, since it is the effective bulk modulus of the entire system that is particularly useful to know.

The pressure wave may travel through the system. The pressure wave may travel through the wellbore, preferably the wellbore annulus. The pressure wave may travel through the riser. The pressure wave may travel through the wellbore and the riser.

By the term "pressure wave" it is intended to be any propagating pressure variation. It may be, but need not be, periodic or cyclical. The pressure wave may take different forms, such as an impulse wave (e.g. a delta function), a step wave, a half sine wave, a full sine wave, a pressure pulse. A pressure wave in the form of a sound wave may be used, with the source hence being a source of a suitable sound.

The time interval may be the time taken for the pressure wave to pass from the source to the reflection location and back to a sensor. The sensor may be a pressure sensor or a flow meter. These components may already be part of the managed pressure drilling system, which means that advantageously no modification is required to allow measurement of the time interval. The choke valve pressure sensor may be used.

The time interval may be the time taken for the pressure wave to pass from the pressure sensor to the reflection location and back to the sensor.

The time interval may be the time difference between the source generating the wave and the sensor detecting the wave, preferably the reflected wave.

The time interval may be the time difference between a first sensor detecting the wave, preferably the direct (non-reflected) wave, and a second sensor detecting the wave, preferably the reflected wave.

The time interval may be the time difference between the sensor detecting the wave, preferably the direct (non-reflected) wave, and the same sensor detecting the reflected wave.

The time interval may the time difference between a first sensor detecting the wave, preferably the direct (non-reflected) wave, and a second sensor detecting the wave, preferably the direct (non-reflected) wave, at a different location to the first sensor preferably upstream of the first sensor.

The time interval may be calculated between arrivals of corresponding portions of the pressure wave. For example, the time interval may be measured from peak-to-peak, or between initial arrivals.

The sensor may be located proximate to the source. The sensor may be located upstream of the source. The sensor may be located between the source and the wellbore. The sensor may be located in the topside. The second sensor (when present) may be located upstream of the sensor, preferably in the riser or the wellbore.

The sensor may be an existing pressure sensor of the topside. A typical topside in a managed pressure drilling system already comprises a pressure sensor upstream of the choke valve that is used to monitor the pressure of the system. This existing pressure sensor may be used. An advantage of the present method is that no additional hardware need be added to an existing managed pressure drilling system in order to perform the method.

The sensor may be an existing flow meter of the topside. A typical topside in a managed pressure drilling system already comprises a flow meter used to monitor the material flow of the system. This existing flow meter may be used. An advantage of the present method is that no additional hardware need be added to an existing managed pressure drilling system in order to perform the method.

The method may comprise calculating the speed of sound in the system using the time interval and the length and calculating the effective bulk modulus of the system using the calculated speed of sound in the system.

The speed of sound may be calculated using the formula $$c = \frac{\text{distance travelled by pressure wave}}{\text{time interval}}.$$

This may preferably be, $$c = \frac{2(\text{length of wellbore})}{\text{final time} - \text{initial time}},$$

where the initial time is the time that the source generates the pressure wave or the time that the pressure wave passes the (first) sensor, and the final time is the time the (reflected) pressure wave passes the (second) sensor.

The effective bulk modulus β can be calculated from the time interval Δt, the length l and the density of the system ρ using the formula, $$\beta = \left(\frac{l}{\Delta t}\right)^2 \rho$$

or from the speed of sound in the system c and the density of the system ρ using the formula, $\beta = c^2\rho$.

The density of the system may be the density of the material used in the managed pressure drilling system to control the pressure. The material may comprise mud and/or cuttings. The material may be passing through the wellbore annulus and/or the riser and/or the topside. The material may be a fluid. The material may be present between the source and reflection location.

The density may be the bulk density.

The method may comprise finding the density of the system p. This may be known for a particular location or system, or may be calculated and/or monitored using a density meter or a flow meter, such as a mass flow meter, such as a Coriolis meter. The density may also be derived from pressure readings in the riser and/or wellbore. The density may be measured at the topside. A typical topside in a managed pressure drilling system already comprises a density sensor, e.g. a flow meter. This existing sensor may be used. The flow meter may be the same flow meter used to measure pressure wave. An advantage of the present method is that no additional hardware need be added to an existing managed pressure drilling system in order to perform the method.

In another aspect, the invention provides a method of tuning a managed pressure drilling system, comprising: using the effective bulk modulus of the managed pressure drilling system obtained by any of the above-discussed method features during the tuning of the managed pressure drilling system. This method may also comprise obtaining the effective bulk modulus, preferably by performing any of the above-discussed method features. The managed pressure drilling system may be tuned, at least partially, using the existing component of the managed pressure drilling system that is used for generating the pressure wave.

In another aspect, the invention provides a method of obtaining an effective bulk modulus of a managed pressure drilling system, the method comprising: obtaining a first effective bulk modulus; measuring the material bulk modulus of the drilling fluid in the managed pressure drilling system; calculating the portion of the first effective bulk modulus not originating from the material bulk modulus of the drilling fluid; changing the drilling fluid in the managed pressure drilling system, wherein the material bulk modulus of the new drilling fluid is known or measured; and calculating a second effective bulk modulus of the managed pressure drilling system using the portion of the first effective bulk modulus not originating from the material bulk modulus of the original drilling fluid and the material bulk modulus of the new drilling fluid, The first effective bulk modulus may be obtained using any of the above-discussed methods. It can be desirable for the fluid (e.g. drilling fluid, like mud) in a managed pressure drilling system to be changed. The method of this aspect, allows the effective bulk modulus of the managed pressure drilling system with the new fluid to be found without needing to perform the entire method of the first aspect again.

In another aspect the invention provides a managed pressure drilling system comprising one or more sensors configured to measure the time interval for a pressure wave to travel over a distance in the system; and a processor configured to calculate an effective bulk modulus of the system using the time interval and the length.

The processor may be configured to calculate the speed of sound in the system using the time interval and the length and to calculate the effective bulk modulus of the system using the calculated speed of sound in the system.

The source of the pressure wave may be an existing component of the system. Thus, no additional hardware may be needed. The existing component may be a back pressure pump. The existing component may be a choke valve.

The system may comprise a wellbore and/or a riser. The wellbore may comprise a wellbore annulus. The riser may be attached to the wellbore. The riser and the wellbore may be connected such that the material may pass between the riser and the wellbore, preferably the wellbore annulus.

A drill string may be located within the wellbore and/or the riser. The drill string may be located within the wellbore inward of the wellbore annulus. The wellbore annulus and/or the riser may provide a path for material, such as mud/cuttings, to be transported away from the drilling location, typically at the bottom of the wellbore.

The system may comprise a topside. A topside is an existing part of a managed pressure drilling system. A topside is typically located at an upper part of the wellbore or riser, preferably the substantially uppermost part of the wellbore or riser. The topside may be a line that comprises components that are used to manage the pressure of the system (such as choke(s), flow meter(s), back pressure pump(s) and pressure sensor(s)). The source may be at a topside location of the system. The topside may be connected to the wellbore or riser such that the pressure in the wellbore and/or the riser can be controlled.

The sensor(s) may be located proximate to the source. The sensor(s) may be located upstream of the source. The sensor(s) may be located between the source and the wellbore or riser. The sensor(s) may be located in the topside.

The sensor may be an existing pressure sensor of the topside. A typical topside in a managed pressure drilling system already comprises a pressure sensor upstream of the choke valve that is used to monitor the pressure of the system. This existing pressure sensor may be used. Advantageously, no additional hardware need be added to an existing managed pressure drilling system.

The sensor may be an existing flow meter of the topside. A typical topside in a managed pressure drilling system already comprises a flow meter used to monitor the material flow of the system. This existing flow meter may be used. Again, this provides the advantage that no additional hardware need be added to an existing managed pressure drilling system.

The system may comprise a density ρ sensor for measuring the density of the material. The density ρ may be calculated and/or monitored using a flow meter, such as a mass flow meter, such as a Coriolis meter. The flow meter may be the same flow meter used to measure pressure wave. The density ρ sensor may be located at the topside. A typical topside in a managed pressure drilling system already comprises a density sensor, e.g. a flow meter. This existing sensor may be used, again providing the advantage that no additional hardware need be added to an existing managed pressure drilling system.

The sensor(s) may be connected to the processor. The source may be connected to the processor. The processor may be configured to perform any of the above discussed methods. The processor may be connected to the source. The processor may be connected to, or may be part of, a controller. The controller may be configured to actuate the source, e.g. open/close the choke valve, to generate the pressure wave.

The system may comprise a drive, such as a motor, connected to the choke valve for driving the choke valve.

The choke valve may be a first choke valve. The system may comprise a second choke valve in parallel to the first choke valve. The second choke valve may provide redundancy to the system. There may be three, four or five choke valves in parallel.

The system may be configured such that the sensor(s) may be used to measure the time interval regardless of which choke is used.

Alternatively, each choke valve may have respective sensor(s) for measuring the time interval when only their respective choke is used to generate the pressure wave. The sensor(s) of each choke valve may be connected to respective controllers or to the same controller. The controller(s) may be configured to perform any of the above discussed methods.

The system may also comprise a plurality of sensors, so as to provide redundancy to the system.

BRIEF DESCRIPTION OF THE DRAWING

A preferred embodiment will now be described, by way of example only, with reference to accompanying FIG. 1, which shows a schematic view of a managed pressure drilling system.

DETAILED DESCRIPTION OF THE INVENTION

The system 1 comprises a wellbore 2. The wellbore 2 comprises an inner bore 3 and an outer annulus 4. The upstream end of inner bore 3 is connected to a rig pump 5. The downstream end of inner bore 3 ends proximate the bottom of the wellbore 2. The rig pump 5 is fed with material, such as mud, from a pit and pumps the material to the bottom of the wellbore 2 through the inner bore 3. The upstream end of the annulus 4 is located at the bottom of the wellbore 2. Thus, in use, material, such as mud and cuttings, enters the bottom of the annulus 4 and flows upward through the annulus 4. The upward flow of the material occurs due to pressure at the bottom of the annulus 4 being greater than pressure at the top of the annuls 4. At the top of the annulus 4 there is a seal 6 that seals between the inner bore 3 and the annulus 4 to prevent material exiting the annulus 4 where the inner bore 3 enters the annulus 4. The annulus 4 may be formed between an outer casing and the casing of the inner bore 3 that passes through the outer casing.

Proximate the top of the wellbore 2 and annulus 4 there is a topside 10. The topside 10 is connected to the annulus 4 such that material may flow between the upper part of the annulus 4 and the topside 10. The topside comprises a pressure sensor 11, a choke valve 12 and a flow meter 13 connected together with lines that allow the flow of material therethrough. The pressure sensor 11 is located between the annulus 4 and the choke valve 12 and the choke valve 12 is located between the flow meter 13 and the pressure sensor 11. In use, the pressure sensor 11 is upstream of the choke valve 12 which in turn is upstream of the flow meter 13 and they are connected with lines in series. Material exits the annulus 4 near the top of the annulus 4 into the topside 10, passes by pressure sensor 11, passes through choke valve 12 (if it is open) and then passes through flow meter 13. The material exiting the flow meter 13 may be discarded, or may be stored in the pits (not shown).

The topside 10 also comprises a back pressure pump 14. A line exiting the back pressure pump 14 is connected to the line between the pressure sensor 11 and the choke valve 12. The back pressure pump 14 is fed with material, such as mud, from a pit and, when in use, pumps the material to the line upstream of the choke valve 12.

It is very important to control the pressure in the wellbore 2, and in particular the wellbore annulus 4, so as to maintain the correct pressure at the bottom of the wellbore 2. If the pressure is too low this can lead to an influx of hydrocarbons into the well during drilling or wellbore collapse. If the pressure is too high this can lead to wellbore 2 fracture, for example the casings may fracture. The pressure is controlled using the rig pump 5 and the choke valve 12 in combination. As can be appreciated, the choke valve 12 can provide a varying back pressure into the wellbore 2. Further, when the rig pump 5 is off or working at low capacity, the back pressure pump 14 may be used to provide back pressure to the wellbore 2. The flow of material in the system is shown in the arrows of FIG. 1. The pressure sensor 11 and the flow meter 13 are typically used to monitor the system. For instance, the pressure sensor 11 is used to detect whether the pressure of the material in the system is acceptable.

A proposed method for obtaining an effective bulk modulus of a managed pressure drilling system utilizes the existing components of the managed pressure drilling system for this different additional purpose. The pressure sensor 11, the choke valve 12 and the flow sensor 13 are connected to a processor (not shown). The processor is configured to measure the pressure using the pressure sensor 11. The processor may be part of a controller configured to control the opening/closing of the choke valve 12 and to measure the flow rate using the flow sensor 13.

First, the controller opens and/or closes the choke valve 12 over a short time scale, such as less than 1 s. Since the material upstream of the choke valve 12 is pressurized, this opening and/or closing of the choke valve 12 produces a pressure wave that propagates upstream. The pressure wave may also propagate downstream, but this is of no significance to the present method. The pressure wave therefore passes through the material in the line between the choke valve 12 and through the material in the annulus 4 until the pressure wave reaches the bottom of the wellbore 2.

Second, as the pressure wave from the choke valve 12 passes the pressure sensor 11, the pressure sensor senses the pressure wave and the processor measures the time of the arrival of the pressure wave.

Once the pressure wave reaches the bottom of the wellbore 2, it is reflected back up through the material in the annulus 4. Once the reflected pressure wave reaches the topside 10 it propagates through the line connecting the annulus to the choke valve 12.

Third, as the reflected pressure wave passes the pressure sensor 11, the pressure sensor senses the reflected pressure wave and the processor measures the time of the arrival of the reflected pressure wave.

Fourth, the processor calculates the time interval between the arrival of the generated pressure wave and the arrival of the reflected pressure wave.

Fifth, the processor calculates the speed of sound in the system. This is done using the distance between the pressure sensor and the bottom of the wellbore (which is known) and the time interval, for example by dividing twice the distance by the time interval or by dividing the distance by half the time interval.

Sixth, using the speed of sound in the system, the bulk modulus is calculated using $\beta=c^2\rho$.

Alternatively, the processor can calculate the bulk modulus directly from the distance between the pressure sensor and the bottom of the well bore (½) and the time interval ($\Delta t$) and the density $\rho$ using the formula $$\beta=\left(\frac{l}{\Delta t}\right)^2\rho.$$

The invention claimed is:

1. A method of obtaining an effective bulk modulus of a managed pressure drilling system, the method comprising:

generating a pressure wave in the managed pressure drilling system;

measuring a time interval for the pressure wave to travel over a distance in the managed pressure drilling system; and calculating the effective bulk modulus of the managed pressure drilling system using the time interval and the distance.

2. The method as claimed in claim 1, wherein the pressure wave propagates through drilling fluid in a wellbore of the managed pressure drilling system and components of the managed pressure drilling system contacted by the drilling fluid.

3. The method as claimed in claim 1, wherein the pressure wave travels through at least 25% of a length of the wellbore.

4. The method as claimed in claim 1, further comprising:

calculating a speed of sound in the managed pressure drilling system using the time interval and the distance; and calculating the effective bulk modulus of the managed pressure drilling system using the speed of sound in the managed pressure drilling system which has been calculated.

5. The method as claimed in claim 1, wherein the pressure wave is generated using an existing component of the managed pressure drilling system.

6. The method as claimed in claim 5, wherein the existing component is a choke valve.

7. The method as claimed in claim 6, wherein the existing component is configured to be used during tuning of the managed pressure drilling system.

8. The method as claimed in claim 1, wherein the pressure wave is generated at a topside location of the managed pressure drilling system.

9. The method as claimed in claim 1, wherein the distance in the managed pressure drilling system travelled by the pressure wave is double a length of a wellbore from a topside of the wellbore to the bottom of the wellbore.

10. The method as claimed claim 1, wherein the pressure wave travels from a generation location at which the pressure wave is generated to a reflection location where the pressure wave is reflected.

11. The method as claimed in claim 10, wherein the reflection location is a bottom of a wellbore.

12. The method as claimed in claim 1, the pressure wave travels through at least one of a wellbore and a riser.

13. The method as claimed in claim 1, wherein the time interval is a time taken for the pressure wave to travel from a pressure sensor to a reflection location and back to the pressure sensor.

14. The method as claimed in claim 1, wherein the effective bulk modulus $\beta$ is calculated from the time interval $\Delta t$, the distance l and a density of the managed pressure drilling system $\rho$ using a formula, $$\beta=\left(\frac{l}{\Delta t}\right)^2\rho,$$

or from a speed of sound in the managed pressure drilling system c and the density of the managed pressure drilling system $\rho$ using a formula $\beta=c^2\rho$, where the speed of sound in the managed pressure drilling system is $$c=\frac{l}{\Delta t}.$$

15. The method as claimed in claim 1, further comprising finding a density of the managed pressure drilling system $\rho$.

16. A method of tuning a managed pressure drilling system, the method comprising: using the effective bulk modulus of the managed pressure drilling system obtained by the method of claim 1 during the tuning of the managed pressure drilling system.

17. A method of obtaining an effective bulk modulus of a managed pressure drilling system with a first drilling fluid, the method comprising:

obtaining a first effective bulk modulus;

measuring a material bulk modulus of the first drilling fluid in the managed pressure drilling system;

calculating a portion of the first effective bulk modulus not originating from the material bulk modulus of the first drilling fluid;

changing the first drilling fluid in the managed pressure drilling system, wherein a material bulk modulus of a second drilling fluid is known or measured; and calculating a second effective bulk modulus of the managed pressure drilling system using the portion of the first effective bulk modulus not originating from the material bulk modulus of the first drilling fluid and the material bulk modulus of the second drilling fluid.

18. A managed pressure drilling system comprising:

one or more sensors configured to measure a time interval for a pressure wave to travel over a distance in the managed pressure drilling system; and a processor configured to obtain an effective bulk modulus of the managed pressure drilling system using the time interval and the distance.

19. The managed pressure drilling system as claimed in claim 18, wherein the processor is configured to: (i) calculate a speed of sound in the managed pressure drilling system using the time interval and the distance; and (ii) calculate the effective bulk modulus of the managed pressure drilling system using the speed of sound in the managed pressure drilling system which has been calculated.

20. The managed pressure drilling system as claimed in claim 18, further comprising a source configured to generate the pressure wave in the managed pressure drilling system.

21. The managed pressure drilling system as claimed in claim 20, wherein the source configured to generate the pressure wave in the managed pressure drilling system is an existing component of the managed pressure drilling system.

* * * * *